US005402590A

United States Patent [19]

Lee

[11] Patent Number: 5,402,590

[45] Date of Patent: Apr. 4, 1995

[54] CHILDREN'S SHOES HAVING A MUSICAL BOX

[76] Inventor: Hyun Gi Lee, 459-16, 3-Dong,, Gaya Pusanjin-Ku, Pusan, Rep. of Korea

[21] Appl. No.: 108,007

[22] Filed: Aug. 18, 1993

Related U.S. Application Data

[63] Continuation of Ser. No. 725,607, Jul. 3, 1991, abandoned.

[30] Foreign Application Priority Data

May 15, 1991 [KR] Rep. of Korea ..... 19917083

[51] Int. Cl.[6] ..... A43B 23/00

[52] U.S. Cl. ..... 36/139; 36/112

[58] Field of Search ..... 36/139, 132, 136, 1, 36/54, 112

[56] References Cited

U.S. PATENT DOCUMENTS

| | | | |
|---|---|---|---|
| 2,160,756 | 5/1939 | Schreck . | |
| 2,320,560 | 6/1943 | Braddock . | |
| 2,612,135 | 9/1952 | Iny . | |
| 2,940,184 | 6/1960 | Malone | 36/139 |
| 3,018,570 | 1/1962 | Bliese | 36/136 |
| 4,034,241 | 8/1977 | Liu | 36/139 |
| 4,372,060 | 2/1983 | Adamik | 36/136 |
| 4,646,350 | 2/1987 | Batra | 36/139 |
| 4,771,556 | 9/1988 | Kim | 36/139 |
| 4,955,150 | 9/1990 | Fagan | 36/136 |
| 5,159,768 | 11/1992 | Longo, Jr. | 36/139 |

FOREIGN PATENT DOCUMENTS 90-2200 3/1990 Rep. of Korea .

*Primary Examiner*—Paul T. Sewell
*Assistant Examiner*—Thomas P. Hilliard
*Attorney, Agent, or Firm*—Birch, Stewart, Kolasch & Birch

[57] ABSTRACT

Children's shoes having a music box built in the front upper portion thereof for amusement especially of young children. The music box includes a melody speaker, a touch activated switch, a battery source, and a waterproof enclosure housing the speaker and the switch therewithin.

4 Claims, 1 Drawing Sheet

CHILDREN'S SHOES HAVING A MUSICAL BOX

This application is a continuation of application Ser. No. 07/725,607, filed on Jul. 3, 1991, now abandoned.

BACKGROUND OF THE INVENTION

1. Field of the Invention

The present invention relates to children's shoes having a music box built therein and more particularly, to a pleasingly musical sound emitter mounted to an upper portion of footwear such as a child shoe, an athletic shoe, a sports shoe, or the like for amusement especially of young children, whereby since the footwear provides an attractive representation, the child wearer wants to wear the footwear on the feet.

2. Description of the Prior Art

Several types of footwear having a sound system are known in the art. U.S. Pat. No. 2,160,756 discloses a slipper of the bunny-shoe type especially designed for use by children, which has a squawker, whistle, or sound device incorporated therein. U.S. Pat. No. 2,230,560 discloses a toy comprising right and left elements which a child may removably attach to his shoes and which will produce an amusing sound with each step the child takes in ordinary walking. U.S. Pat. No. 2,612,135 discloses a tinkle bell carried by a shoelace. Korean Patent Publication No. 90-2200 discloses children's shoes including a speaker, a separate basic member, and wires connected to both the speaker and the basic member attached thereto. However, such prior devices do not disclose the use of a speaker or a composite structure of a speaker and a basic member, a waterproof enclosure for housing a musical member, and a switch selectively actuated by a child wearer.

SUMMARY OF THE INVENTION

Accordingly, it is an object of the present invention to provide improved children's shoes having a music box built therein.

Another object of the present invention is to provide a children's footwear which includes a music box including a switch, a melody speaker, a battery source, and a waterproof enclosure for housing the switch, speaker, and battery source therewithin for preventing the music box from suffering a water damage by water such as from rain, cleaning water or the like.

A further object of the present invention is to provide a pleasingly musical sound emitter built in the front upper portion of the footwear, whereby since the footwear provides an attractive representation when the child wearer selectively touches the musical sound emitter, the child wearer wants to wear the footwear on the feet.

Still another object of the present invention is to provide an improved music box to be built in children's footwear, which is simple in construction, compact for portability, inexpensive to manufacture, durable in use, and refined in appearance.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
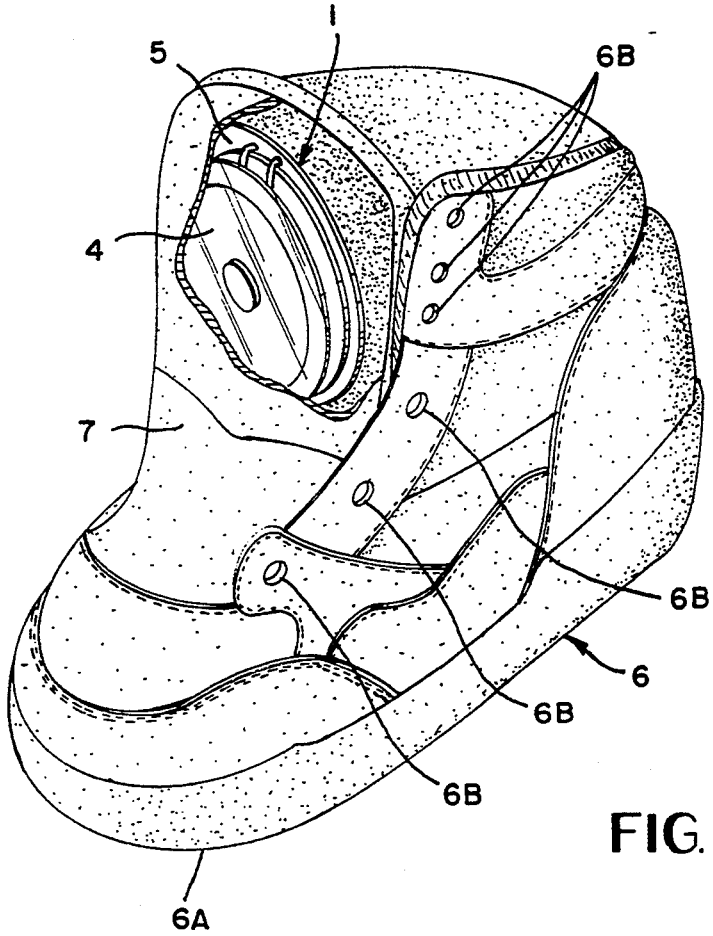
FIG. 1 is a perspective view of the child's shoe having a music box built therein, containing cut-away portions in order to illustrate the construction of the shoe according to the present invention.
Figure 2:
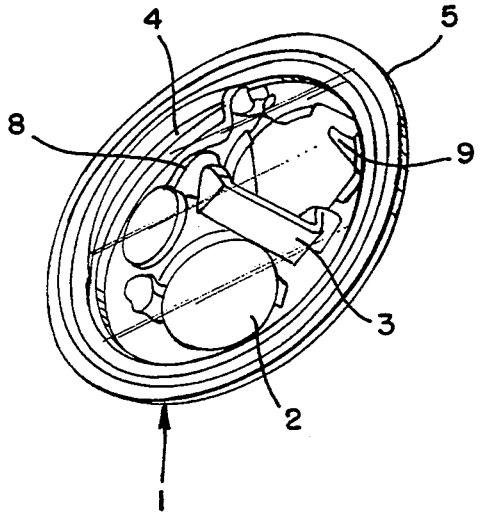
FIG. 2 is a perspective view of the music box containing cutaway portions in order to illustrate the construction of the music box according to the present invention.

Referring now in detail to the drawings for the purpose of illustrating preferred embodiments of the present invention, the children's shoes having a music box as shown in FIGS. 1 and 2, comprises a music box 1 built in a tongue portion 7 of a child footwear 6 such as a child shoe, an athletic shoe, a sports shoe including a sole 6A and a lace type fastening means 6B, or the like for generating a pleasing sound to be heard from the tongue portion 7 when the child wearer touches the front tongue portion while putting on the footwear 6 on the feet or after the child wears the footwear 6 on the feet.

The music box 1 includes a battery source 2, a resilient push switch 3, a speaker 4, a plurality of electric wires 8 connecting the battery source 2, switch 3 and speaker 4, a basic plate 9 supporting the battery source 2, switch 3, speaker 4 and plurality of electric wires 8, and a waterproof enclosure 5 housing the battery source 2, switch 3, speaker 4, plurality of wires 8 and basic plate 9 therewithin.

The resilient push switch 3 is disposed in the front portion of the music box 1 for direct flexing movement in conjunction with a touch thereof by the child wearer while he is wearing or after he wears the footwear 6 on the feet. When the user touches the front upper portion of the tongue 7, the resilient push switch 3 is closed as an on-position and generates a melodic sound for amusement especially of the young children. The waterproof enclosure 5 includes a resilient seal interface member such as rubber, vinyl, or the like for sealing the battery source 2, switch 3, speaker 4, electric wires 8, and basic plate 9. The waterproof enclosure 5 may be hinged so as to enable removal and replacement of the battery source 2.

The music box 1 is built in the tongue portion 7 of the children's shoes 6 by sewing the children's shoes 6 after the musical box 1 is inserted into the tongue portion 7 of the children's shoes 6 in manufacturing steps. Sometimes, if necessary, the music box 1, can be inserted into a pocket formed in the tongue portion 7 of the children's shoes 6 (not shown).

The children's shoes 6 having the music box 1 built therein according to the present invention operates as follows. When the child wears the children's shoes 6 on the feet and fastens the shoelace, the child wearer usually touches the resilient push switch 3 of the music box 1 built in the shoe 6. At this time, the music box 1 generates pleasingly melodic music, whereby the child wearer wants to wear the shoes on the feet very frequently so as to attract and treat a child who does not want to wear his shoes on the feet. Further, after the child wears the shoes 6 on the feet, the child wearer can touch the tongue portion 7 of his shoes 6 for more amusing sound. Since the music box is surrounded by the waterproof enclosure 5, the shoes 6 can be cleaned in water or worn in the rain or on a wet floor.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is

1. A child's shoe comprising:

a sole portion connected to an upper portion;

a tongue member provided in connection with the upper portion and positioned at a toe end of said shoe;

lace type fastening means formed in the upper portion of said shoe adjacent said tongue member for securing the shoe to a foot; and a music source entirely housed in said tongue member, said music source including a basic supporting plate, a speaker supported on said basic supporting plate, a battery source supported on said basic supporting plate, a resilient push button switch disposed on the front portion of said music source and supported on said basic supporting plate to be closed and simultaneously actuated only by pushing said resilient push button switch, a plurality of wires connected to said speaker, said battery source, and said resilient push button switch, and an enclosure for housing said basic supporting plate, said speaker, said battery source, said resilient push button switch, and said wires, whereby depression of said front upper portion of said shoe generates a melodic sound by said music source, and wherein said push button switch is actuable independent of a lacing of said lace type fastening means around said tongue member.

2. The shoe according to claim 1, wherein said enclosure is made of waterproof materials.

3. The shoe according to claim 2, wherein said enclosure is made of rubber.

4. The shoe according to claim 2, wherein said enclosure is made of vinyl.

* * * * *